United States Patent [19]

Yolton et al.

[11] 4,374,075

[45] Feb. 15, 1983

[54] METHOD FOR THE PLASMA-ARC PRODUCTION OF METAL POWDER

[75] Inventors: Charles F. Yolton, Coraopolis, Pa.; Thomas S. Cloran, East Liverpool, Ohio; Thomas W. Sloan, Calcutta, Ohio

[73] Assignee: Crucible Inc., Pittsburgh, Pa.

[21] Appl. No.: 274,604

[22] Filed: Jun. 17, 1981

[51] Int. Cl.[3] ..... B01J 2/04

[52] U.S. Cl. ..... 264/8; 264/10; 264/12

[58] Field of Search ..... 264/8, 10, 12

[56] References Cited

U.S. PATENT DOCUMENTS

| | | | |
|---|---|---|---|
| 3,275,787 | 9/1966 | Newberry | 264/10 |
| 3,784,656 | 1/1974 | Kaufmann | 264/10 |
| 3,943,211 | 3/1976 | Dickey et al. | 264/15 |
| 4,043,716 | 8/1977 | Lafferty et al. | 264/10 |
| 4,221,554 | 9/1980 | Oguchi et al. | 264/15 |

*Primary Examiner*—James R. Hall

*Attorney, Agent, or Firm*—Clair X. Mullen, Jr.

[57] ABSTRACT

A method for producing atomized metal particles, particularly of titanium-base alloys and superalloys, that are free from contamination by foreign material; this is achieved by providing a rod of the metal to be atomized and contacting an end portion of the rod with a plasma arc gas jet which simultaneously melts and atomizes the metal from the rod to form the atomized particles and preventing contamination of the particles.

9 Claims, 3 Drawing Figures

METHOD FOR THE PLASMA-ARC PRODUCTION OF METAL POWDER

It is known to produce metal particles for consolidation by various powder metallurgy techniques, including hot isostatic pressing, by striking a molten stream of the metal with a gas jet to atomize the same to form discrete droplets which are then solidified to form the metal particles. Typically, in applications of the type, the metal to be atomized is contained in a tundish set atop an atomizing chamber. The metal exits from the tundish and into the atomized chamber through a nozzle in the tundish bottom, and upon entering the atomizing chamber the molten metal is struck with a gas jet typically of argon, nitrogen, or helium. This atomizes the molten metal stream into discrete droplets, which during their travel through the atomizing chamber solidify and are collected in the bottom thereof. Typically, the atomizing chamber is provided with an inert-gas atmosphere to prevent oxidation of the particles prior to solidification. In some instances, with respect to highly oxidizable metals, such as various superalloys, the particles are collected in a liquid medium, such as liquid argon, in the atomizing chamber bottom. In the case of titanium-base alloys, because of the highly reactive nature of titanium, this material cannot be present in the molten state without the presence of a noncontaminating atmosphere so that it presents particularly difficult problems from the standpoint of atomizing the same. In atomizing applications of the above-described type the metal in molten form can become contaminated as by contact with the refractory material of the tundish and tundish nozzle through which the metal exits. Erosion from these materials can cause the particles when solidified to contain various undesirable metallics and nonmetallics, such as oxides and metals of the refractory nozzle material. Metal particles for powder metallurgy applications are also produced by melting progressively the end of an elongated electrode of the metal from which the powder is to be produced by axial contact with an electric arc, plasma arc or electron beam. The electrode is rotated axially at high speed, e.g. 15,000 rpm, and the resulting centrifugal force causes the molten metal to form droplets which upon solidification result in the desired powder. Operations of this type require that the electrode be accurately machined to achieve precision straightness and roundness. Otherwise, the necessary high-speed rotation cannot be effectively achieved.

It is accordingly a primary object of the present invention to provide a method for atomizing molten metal wherein contamination is avoided in a relatively inexpensive operation.

This and other objects of the invention as well as a more complete understanding thereof may be obtained from the following description, specific examples and drawings, in which.

The invention in the broad aspect thereof involves melting and simultaneously atomizing a solid article of the metal or alloy from which it is desired to produce particles for powder metallurgy applications by the use of a plasma arc gas jet. The gas jet which in typical applications operates at temperatures on the order of 10,000° to 30,000° F. and employs a gas typically of an argon and hydrogen mixture serves to melt a portion of the alloy from the solid article thereof and simultaneously atomize it. Thereafter, the atomized material is maintained out of contact with any contaminating surfaces or atmospheres prior to solidification. This may be achieved by the use of a conventional atomizing chamber. By the practice of the invention no nozzle, tundish, electrode or other source of contamination is involved in the melting and atomization practice. This is not the case with conventional practices. It is preferred that the solid article of the metal to be atomized is in the form of a rod or bar and that the end portion thereof is melted away by contact with the plasma arc gas jet. To facilitate this action the rod or bar is slowly rotated axially during melting and atomization by the plasma arc gas jet. Also, it is advanced substantially longitudinally toward the jet to progressively melt and atomize metal from the end of the rod. In a more preferred practice, the rod or bar would be positioned substantially vertically with the lower end portion thereof being contacted by the plasma arc gas jet so that the molten atomized material drops substantially vertically through a conventional atomizing chamber having a protective atmosphere therein and provision for collecting the solidified particles in the chamber bottom. Although a single plasma arc gas jet may be employed for this purpose, if two or more jets are used simultaneously and in converging relation to the end of the rod finer atomized particles will result. An additional practice for producing finer particles would involve the use of an inert gas jet in combination with a single plasma arc gas jet. The supplemental gas jet would, of course, contribute to producing finer particles by increasing the atomizing action at the area of melting.

Figure 1:
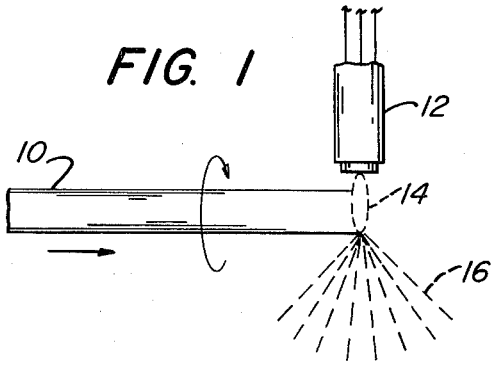
FIG. 1 is a schematic showing of one embodiment of the invention.

With respect to FIG. 1 of the drawings, there is shown a rod or bar 10 of metal or alloy from which it is desired to produce atomized particles. A conventional plasma arc gas jet gun identified as 12, which may be the conventional Model Metco 2MB, produces a plasma jet 14 contacting the end of the rod and simultaneously melting and atomizing metal in molten form from the end of the rod, which material is identified as 16. Preferably, the rod would be supported by means, not shown, for rotating the same during melting. In addition, the atomized material would be within a protective atmosphere in an atomizing chamber and solidified prior to reaching the bottom of the chamber.

Figure 2:
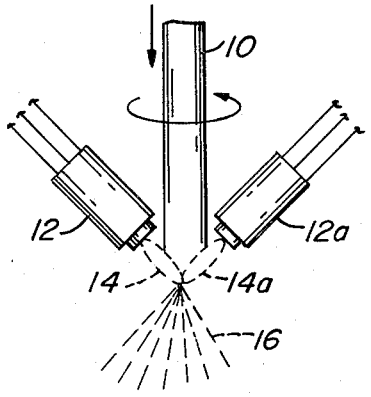
FIG. 2 is a schematic showing of a second and preferred embodiment of the invention.

FIG. 2 shows an alternate practice wherein two identical plasma guns 12 and **12*a*** are directed in converging relation onto the end of the rod. The additional action of two guns tends to increase the atomizing action and thus produce finer particles upon solidification.

Figure 3:
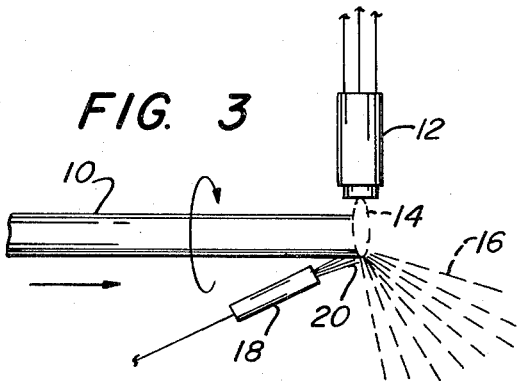
FIG. 3 is a schematic showing of an alternate practice of the invention.

FIG. 3 shows an embodiment wherein, in combination with the plasma gun 12, there is employed a gas jet 18 which strikes the molten material from the end of the rod with a jet of gas, such as argon or helium, identified as 20. The use of the gas jet 18 serves to increase the atomizing action and thus the powder produced is finer than would be the case without the use of the auxiliary gas jet.

As a specific example of the practice of the invention a single plasma arc spray gun of the model described above was employed to melt and simultaneously atomize a solid rod of a titanium-base alloy of 6% aluminum- 4% vanadium balance titanium. The operating conditions are set forth in Table I.

TABLE I

| PLASMA GUN CONDITIONS FOR PRODUCING Ti-6A1-4V POWDER FROM 1.125 IN. DIA. BAR | |
|---|---|
| Primary Gas: | Argon at 100 psi and 200 SCFH |
| Secondary Gas: | Hydrogen at 50 psi and 15 SCFH |
| Voltage: | 63 v |
| Amperage: | 500 amp |
| Power: | 31.5 kw |
| Nozzle Diameter: | 5.5 mm |

The atomizing chamber during this operation was a helium gas atmosphere at a 1 to 4 psi positive pressure. The properties of the powder produced in this operation are set forth on Table II.

TABLE II

| PROPERTIES OF PLASMA-ATOMIZED Ti-6A1-4V POWDER | |
|---|---|
| Bar Diameter: | 1.125 in. |
| Bar Weight: | 3.8 lb. |
| Powder Weight Recovered: | 3.5 lb. |
| Screen Analysis (U.S. Std. Mesh): | |
| Mesh Size | Wt. % |
| +14 | 27 |
| −14+20 | 40 |
| −20+35 | 17 |
| −35+45 | 9 |
| −45+60 | 3.6 |
| −60+80 | 1.6 |
| −80+100 | 0.3 |
| −100+200 | 0.9 |
| −200+325 | nil |
| −325 | nil |

Tap Density (−20 mesh): 3.11 g/cc (70% Theoretical Density)

Flow Rate (−20 mesh): 40 sec

The term "metal" or "titanium" as used herein is understood to include metal alloys generally as well as alloys of titanium, as well as the elemental materials.

The term "solid article" as used herein is understood to include articles that are integral but have less than full density, such as articles produced by powder metallurgy practices.

The term "plasma arc gas jet", as used herein means a gas, such as argon, hydrogen, helium and mixtures, in the form of a high velocity jet that is heated to a high temperature, such as 10,000° to 30,000° F., sufficient to ionize the gas to form a plasma.

We claim:

1. A method for making atomized metal particles, comprising:
   (a) directing a plasma arc gas jet to contact a solid metal article to simultaneously heat, to melt, and to atomize said metal into droplets, and
   (b) cooling said metal droplets to solidification within an inert atmosphere to form said metal particles, while maintaining said droplets free from surface contact prior to solidification.

2. The method of claim 1 wherein said article is in the form of a rod or bar and a portion thereof is in contact with said plasma arc gas jet.

3. The method of claim 2 wherein said rod or bar during contact with said plasma arc gas jet is rotated axially and moved longitudinally towards said jet to progressively heat, melt and atomize metal from an end of said rod or bar.

4. The method of claim 3 wherein said rod or bar is positioned vertically and a lower end portion thereof is contacted with said plasma arc gas jet.

5. The method of claim 4 wherein said lower end portion of said rod or bar is contacted simultaneously by at least two plasma arc gas jets.

6. The method of claim 4 wherein said lower end portion of said rod or bar is contacted with a jet of inert gas simultaneously with said plasma arc gas jet.

7. The method of claim 4 wherein said plasma arc gas jet constitutes a gas selected from the group consisting of argon, helium, hydrogen and mixtures thereof.

8. The method of claim 1 wherein said article is of titanium.

9. The method of claim 1 wherein said article is of a superalloy composition.

* * * * *